US009822516B2

(12) United States Patent
Li

(10) Patent No.: US 9,822,516 B2
(45) Date of Patent: Nov. 21, 2017

(54) EXPLOSION-PROOF METHOD OF A PRESSURE TYPE TOILET TANK AND AN EXPLOSION-PROOF PRESSURE TYPE TOILET TANK

(71) Applicant: Caiyou Li, Zhangzhou (CN)

(72) Inventor: Caiyou Li, Zhangzhou (CN)

( * ) Notice: Subject to any disclaimer, the term of this patent is extended or adjusted under 35 U.S.C. 154(b) by 722 days.

(21) Appl. No.: 14/103,332

(22) Filed: Dec. 11, 2013

(65) Prior Publication Data

US 2014/0208497 A1 Jul. 31, 2014

(30) Foreign Application Priority Data

Jan. 29, 2013 (CN) ..... 2013 1 0034350

(51) Int. Cl.
*E03D 3/10* (2006.01)

(52) U.S. Cl.
CPC ..... *E03D 3/10* (2013.01)

(58) Field of Classification Search
CPC ..... E03D 3/10; E03D 3/012
USPC ..... 4/362
See application file for complete search history.

(56) References Cited

U.S. PATENT DOCUMENTS 5,406,652 A * 4/1995 Hennessy ..... E03D 3/10 4/332

* cited by examiner

*Primary Examiner* — Tuan N Nguyen
(74) *Attorney, Agent, or Firm* — Rabin & Berdo, P.C.

(57) ABSTRACT

An explosion-proof method of an explosion-proof pressure type toilet tank, includes dividing the toilet tank into a closed air container to store air and a closed water container to store water. The water container is disposed with an inlet and an outlet. The air container is connected to the water container by a channel. The air container compressive ultimate strength is larger than that of the water container. When the tank is filled with water, the air in the water container enters the air container through the channel. When the tank pressure is too great, the water container bursts, steadily releasing the air compression of the air container through the channel to prevent the compression air from quickly blowing out.

11 Claims, 8 Drawing Sheets

EXPLOSION-PROOF METHOD OF A PRESSURE TYPE TOILET TANK AND AN EXPLOSION-PROOF PRESSURE TYPE TOILET TANK

FIELD OF THE INVENTION

The present invention relates to a pressure type toilet tank of sanitary ware, especially to an explosion-proof method of a pressure type toilet tank and an explosion-proof pressure type toilet tank.

BACKGROUND OF THE INVENTION

The traditional toilet tank is applied with water level difference of the tank and the toilet to generate pressure to make the flushing water with high speed to clean the toilet. However, when the water level difference is little and the flushing is weak, it needs more water to clean the toilet. So there is pressure type toilet tank in conventional technology. As figured in FIG. 1, the pressure type toilet tank is applied with a closed tank 1', which is stored with some air when it is tanking in water, the air inside the tank is compressed by the water pressure of the water supply pipe, the dynamic of the compression air and the water pressure can release the energy when the tank is flushing by the control of the flush valve 2', making water discharged quickly to the toilet from the outlet of the tank 1' to flush powerfully, thus saving water. Experience has proved that the flush effect and the water saving effect of the pressure type toilet tank of conventional technology are better than the traditional toilet tank which is flushing by the force of the water gravity.

The tank of the pressure type toilet tank of conventional technology is made of metal, so there are disadvantages that it costs high and it is out of step with energy-saving benefit, thus making it difficult to widely use. So that some manufactories use reinforce plastic to replace the expensive metal to make toilet tank. With mature manufacture technology, low cost and high reliably, and with the cooperation of the pressure control system (the pressure maintaining valve 3' in FIG. 1) and the safety device (the safety valve 4' in FIG. 1), this kind of tank is widely manufactured to be provided in the market. However, though this kind of pressure type toilet tank is with well flush effect, energy saving benefit, low cost and popular in the market, it is a security threat. Due to the high water supply pressure and bad manufacturing of the products, if the tank becomes fatigue or the safety device is broken, the inside pressure of the tank may sharply increase and it is hard to release, causing exploding under the strong pressure, the ceramic housing of the tank may be broken to sharp pieces, causing personal injury or property damage.

SUMMARY OF THE INVENTION

The object of the present invention is to overcome the disadvantages of the existing technology and provide with an explosion-proof method of a pressure type toilet tank and an explosion-proof pressure type toilet tank, the present invention resolves the conflicts between cost and safety, avoiding the explosion of the tank of the pressure type toilet. The tank may be split to release the air inside steadily.

The technical proposal of the present invention to solve the technical problems is as below:

An explosion-proof method of a pressure type toilet tank, in which the pressure type toilet tank is divided into a closed air container to store air and a closed water container to store water, the air container is connected to the water container by means of a channel, the limit compressive ultimate strength of the air container is larger than that of the water container; when the tank is filled with water, the air in the water container enters into the air container through the channel; when the pressure of the tank is too great, the water container bursts, making the compression air of the air container released steadily through the channel to prevent the compression air from quickly blowing out and exploding.

An explosion-proof pressure type toilet tank comprises a closed air container to store air and a closed water container to store water, the water container is disposed with an inlet and an outlet; the limit compressive ultimate strength of the air container is larger than that of the water container; the air container is connected to the water container by means of a channel for air inside the water container to enter into the air container.

In another preferred embodiment, one end of the channel is connected to the air container, the other end of the channel is situated at the top of the water container.

In another preferred embodiment, the air container is situated outside the water container.

In another preferred embodiment, the air container is situated inside the water container.

In another preferred embodiment, the channel is a pipe, one end of the pipe is connected to the air container in sealing way, the other end of the pipe is extended into the water container and situated at the top of the inner wall of the water container.

In another preferred embodiment, the channel is a pipe, one end of the pipe is connected to the air container in sealing way, the other end of the pipe is connected to the top of the water container in sealing way for the air inside the water container to enter into the air container through the pipe.

In another preferred embodiment, the channel is a hole, the air container is situated on the water container, the bottom wall of the air container is connected to the top wall of the water container by means of the hole.

In another preferred embodiment, the channel is a pipe, one end of the pipe is extended into the bottom of the inner of the air container, the other end of the pipe is situated at the top of the inner of the water container.

An explosion-proof method of a pressure type toilet tank and an explosion-proof pressure type toilet tank of the present invention are applied with the difference values of the limit compression strength of the water container and the air container to improve the safety: when the water container is taking in water, under the pressure of the water, the air inside the water container is completely driven into the air container and is compressed to be compression air; when the tank is flushing water, the compression air inside the air container is discharged to the water container, making the water inside the water container discharged out quickly by high pressure of the compression air in the upper portion to flush powerfully, thus saving water; if the water supply pressure of the water container is too large, and the tank can't normally release, or if the manufacture is bad, the material of the water container becomes fatigue after long time of use, and the compression strength is reduced, the water container may split, as the compression air is held inside the air container, and the strong pressure of the compression air inside the air container can release through the channel between the air container and the water container, only the water container bursts, the compression air will not blow up quickly and no explosion will happen to damage the ceramic housing of the tank, preventing personal injury or property damage.

Compared to the pressure type toilet tank of the conventional technology, the advantageous effects of the present invention are that: as the pressure type toilet tank is divided into a closed air container to store air and a closed water container to store water, the air container is connected to the water container by means of a channel, the limit compressive ultimate strength of the air container is larger than that of the water container; when the tank is filled with water, the air in the water container is entered into the air container through the channel; when the pressure of the tank is too great, and the inside pressure can't be normally released, or when the compression strength of the water container is reduced, the water container bursts to be leaking, no explosion will happen to damage the ceramic housing of the tank. That is because a lot of the air inside the tank is compressed inside the air container and is separated from the water container, it can be released steadily through the channel between the air container and the water container, the compression air will not blow up quickly and no explosion will happen. The present invention prevents explosion of the pressure type toilet tank, ensuring of security of the human being and property when used.

The present invention of an explosion-proof method of a pressure type toilet tank and an explosion-proof pressure type toilet tank will be further described with the drawings and the embodiments, but it can not be limited to the embodiments.

DETAILED DESCRIPTION

The First Embodiment

An explosion-proof method of a pressure type toilet tank of the present invention is to divide the tank into a closed air container to store air and a closed water container to store water, the air container is connected to the water container by means of a channel for air of the water container to enter into the air container; with the difference of the limit compression strength of the air container and the water container, when the water container bursts, the compression air of the air container releases steadily through the channel, preventing the compression air from blowing up quickly and exploding. The air container is used to store air, that is to say, the air container is normally stored with air, when special case happens, for example when the water supply pressure of the water container is too large, the air container may be stored with some water. The channel can be a hole or a pipe, air inside the water container can completely enter into the air container by reasonably arranging the position of the channel.

Figure 1:
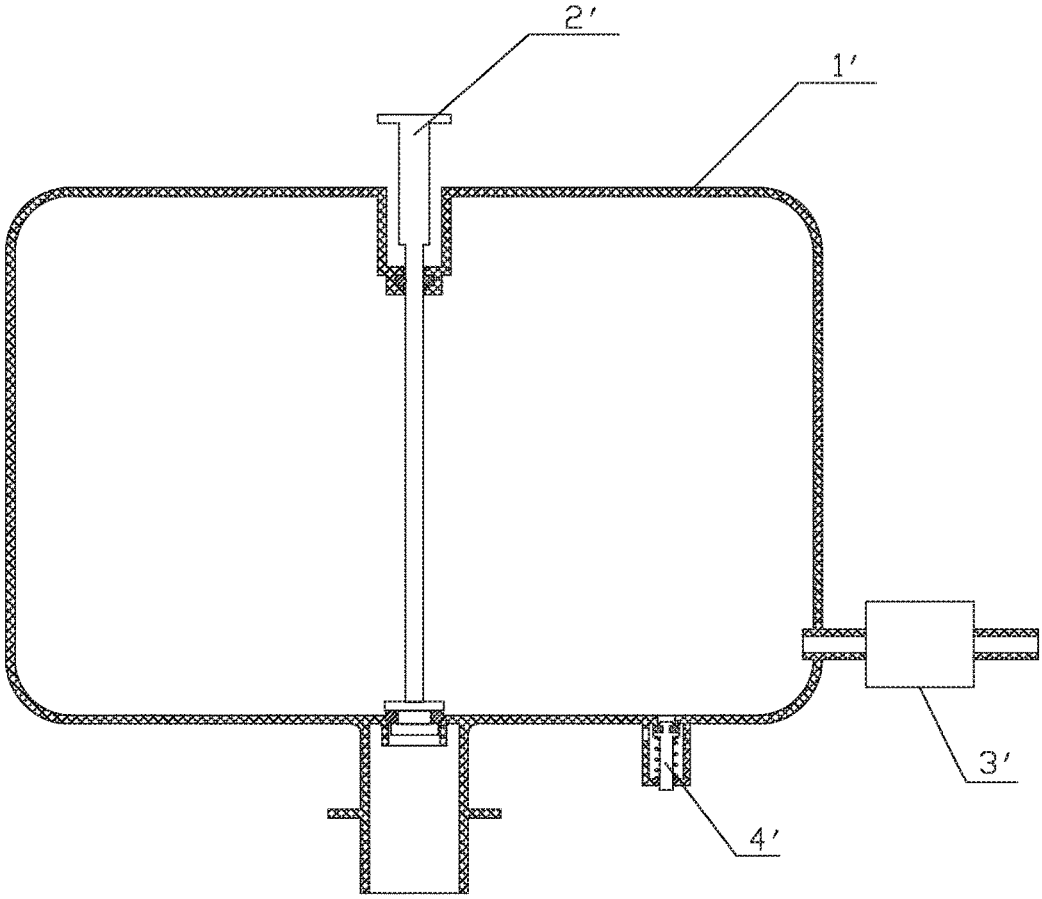
FIG. 1 (Prior Art)
FIG. 1 illustrates a sectional view of the pressure type toilet tank of the conventional technology.
Figure 2:
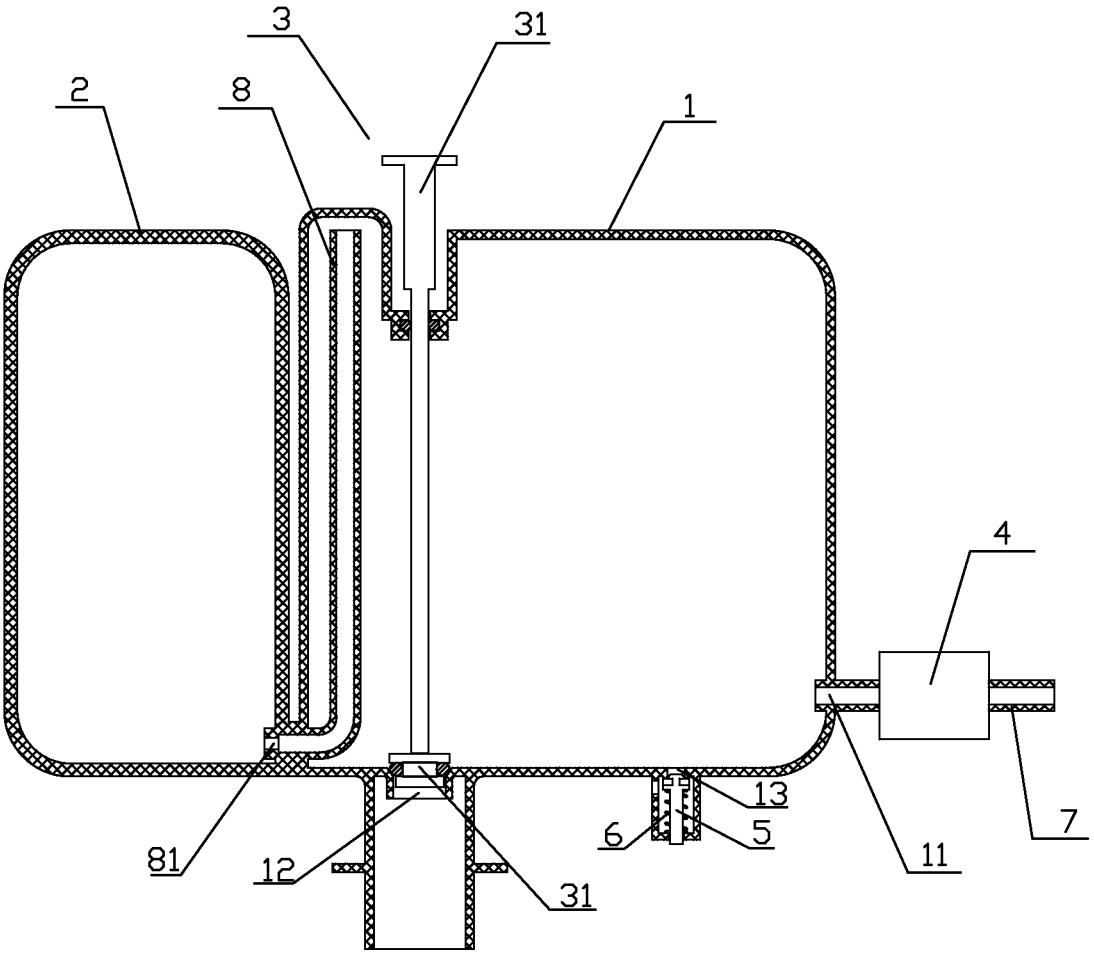
FIG. 2 illustrates a sectional view of the pressure type toilet tank of first embodiment of the present invention.

Refer to FIG. 2. An explosion-proof pressure type toilet tank comprises a closed air container 2 to store air and a closed water container 1 to store water. The bottom of the water container 1 is disposed with an outlet 12, the side wall of the water container 1 is disposed with an inlet 11, the water container 1 is disposed with a flush valve 3 to control the outlet 12, the inlet 11 of the water container is connected to the water supply pipe 7 by a pressure maintaining valve 4. The air container 2 is normally stored with air, when special case happens, for example when the water supply pressure of the water container 1 is too large, the air container 2 may be stored with some water. The limit compression strength of the air container 2 is larger than that of the water container 1. The air container 2 is situated outside the water container 1 and it is connected to the water container 1 by means of a channel, making that the air inside the water container 1 enters into the air container 2 through the channel.

Preferred, the channel connected the air container 2 and the water container 1 is a pipe 8. In detailed, the opening of one end of the pipe 8 is a throttle hole 81 (the sectional area of the throttle hole 81 is set to satisfy the flush condition), this end of the pipe 8 is connected to the bottom of the side wall of the air container 2 in sealing way, making the pipe 8 connected to the air container 2. The rest part of the pipe 8 is extended into the water container 1, the other end of the pipe 8 is situated at the top of the inner of the water container 1, making that the air inside the water container 1 can completely enter into the air container 2 through the pipe 8.

The bottom of the water container 1 is further disposed with a pressure release hole 13, which is assembled with a safely valve 5 by means of a spring 6.

Above flush valve 3 is disposed with a valve rod 31 and a sealing poison 32, the valve rod 31 is partially extended into the water container 1 from the top of the water container 1 in sealing way, the sealing poison 32 is fixed to the bottom of the valve rod 31 to separate from the outlet 12 of the water container or seal up the outlet 12 of the water container 1 with the moving up and down of the valve rod 31.

Figure 3:
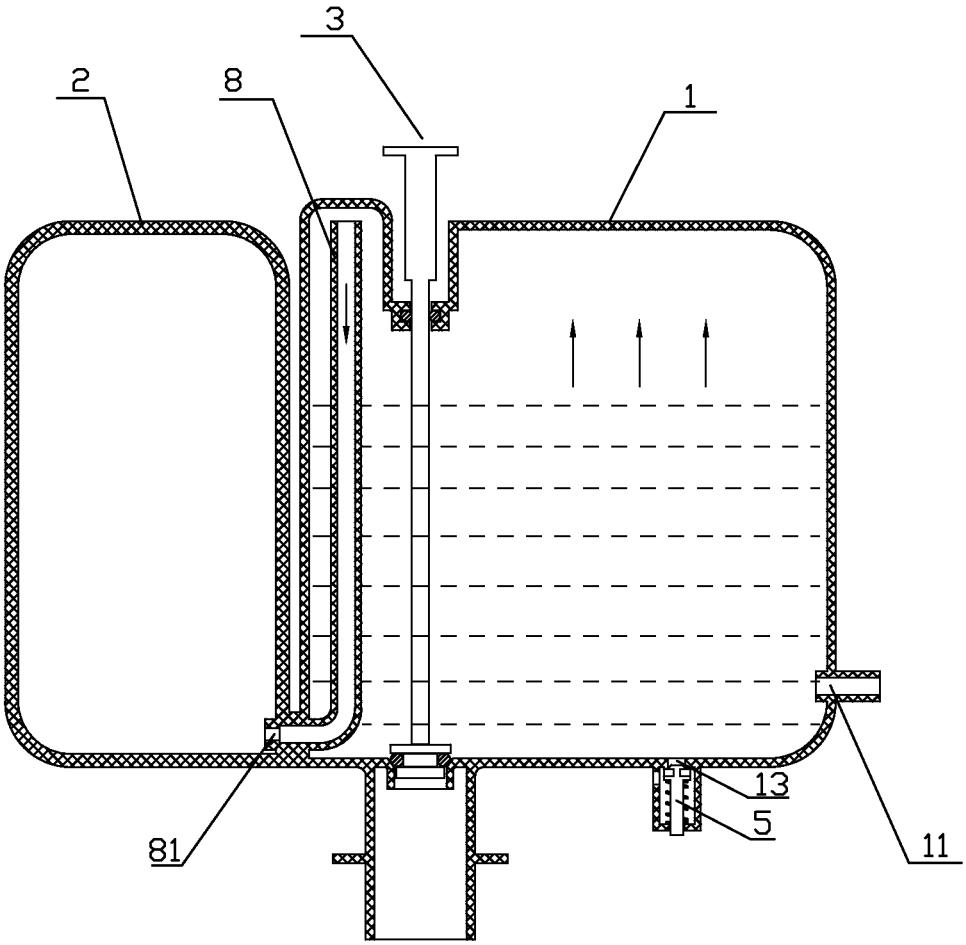
FIG. 3 illustrates a sectional view of the pressure type toilet tank of the first embodiment of the present invention when the water container is taking in water.
Figure 4:
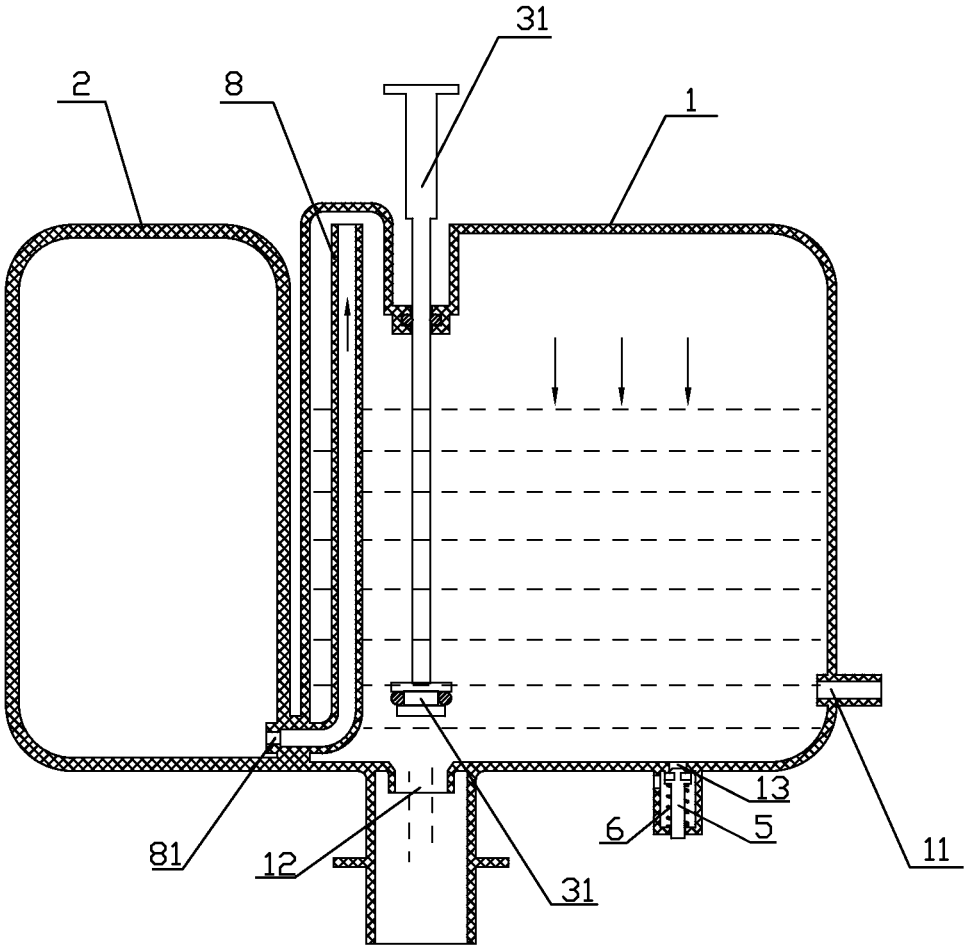
FIG. 4 illustrates a sectional view of the pressure type toilet tank of the first embodiment of the present invention when the water container flushes.

In the explosion-proof pressure type toilet tank, as figured in FIG. 3, the broken line shows the water, the arrow shows the airflow, when the water container 1 is taking in water, the water of the water supply pipe 7 enters into the water container after adjusted by the pressure maintaining valve 4. As the light air is gather in the upper portion of the inner of the water container, when the water container 1 is taking in water, the air in the upper portion of the water container is driven under the work of the water pressure, and then the air enters into the air container 2 through the pipe 8. When water inflow is done, the pressure in the water container 1 and the air container 2 reaches balance, and the water container 1 is just full of water, the small quantity of air inside the water container that did not discharge has limited energy and is unable to be a security threat. As figured in FIG. 4, the broken line shows the water and the arrow shows the airflow, when the tank is flushing, lift up the valve rod 31, making it separated from the outlet 12 of the water container 1, then the inside pressure of the water container 1 reduces, the compression air enters into the water container 1 through the throttle hole 81 and the pipe 8, making the water of the water container 1 discharged out quickly under the strong pressure of the compression air to flush powerfully, thus saving water.

Figure 5:
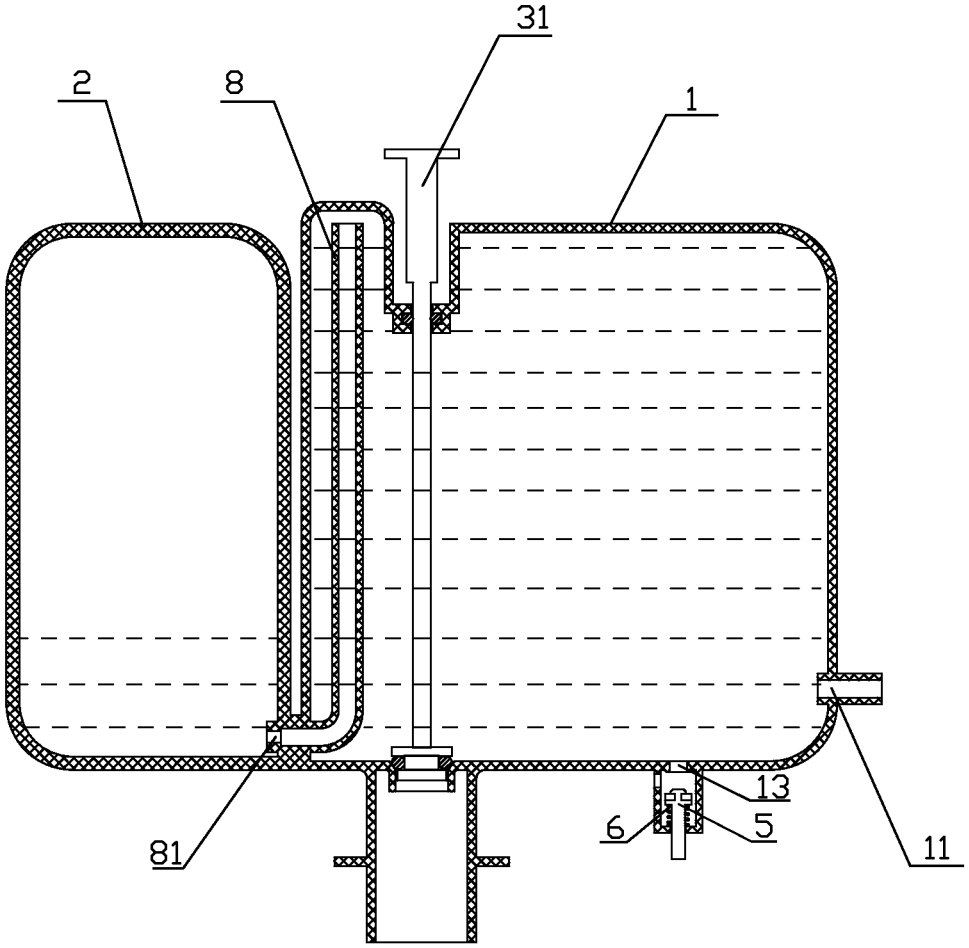
FIG. 5 illustrates a sectional view of the pressure type toilet tank of the first embodiment of the present invention when the water supply pressure of the water container is too large and the water container releases the pressure.

Refer to FIG. 5. the broken line shows water, when the pressure maintaining valve 4 is broken and the water supply pressure of the water container is too large, water of the water supply pipe 7 enters into the water container 1 steadily, then enters into the air container 2 through the pipe 8 under high pressure after the water container 1 is full, so that the air container 2 is filled with some water, and air inside the air container 2 is compressed. In this time, the inside pressure of the water container 1 increases, causing the safety valve 5 overcoming the elastic force of the spring 6 to move downwards to open the pressure release hole 13 of the water container 1, the inside pressure of the water container 1 is released through the pressure release hole 13 to achieve the purpose of safely use.

Figure 6:
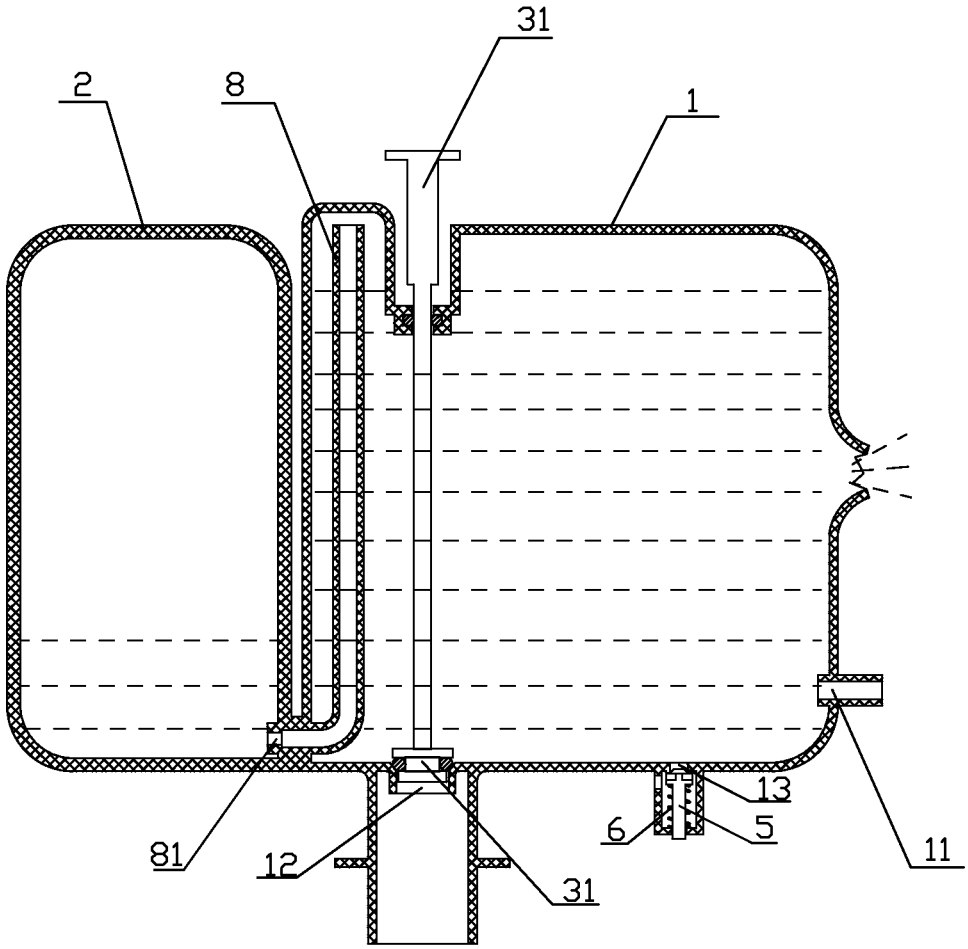
FIG. 6 illustrates a sectional view of the pressure type water tank of the first embodiment of the present invention when the water container bursts.

Refer to FIG. 6, the broken line shows water, when the pressure maintaining valve 4 is broken, the safety valve 5 is unavailable and the water container 1 can't work to release the inside pressure or when the water container 1 is bad in manufacture, the material of the water container 1 becomes fatigue and the compression strength is reduced, as the limit compression strength of the water container is lower than that of the air container 2, the water container 1 will burst to leak under the work of the water pressure, the damaging compression air is held inside the air container 2, which is separated from the water container 1, and then released steadily through the throttle hole 81 and the pipe 8 (some water inside the air container 2 will be firstly discharged through the throttle hole 81 and the pipe 8, then the air is discharged), no damage will happen.

The Second Embodiment

Figure 7:
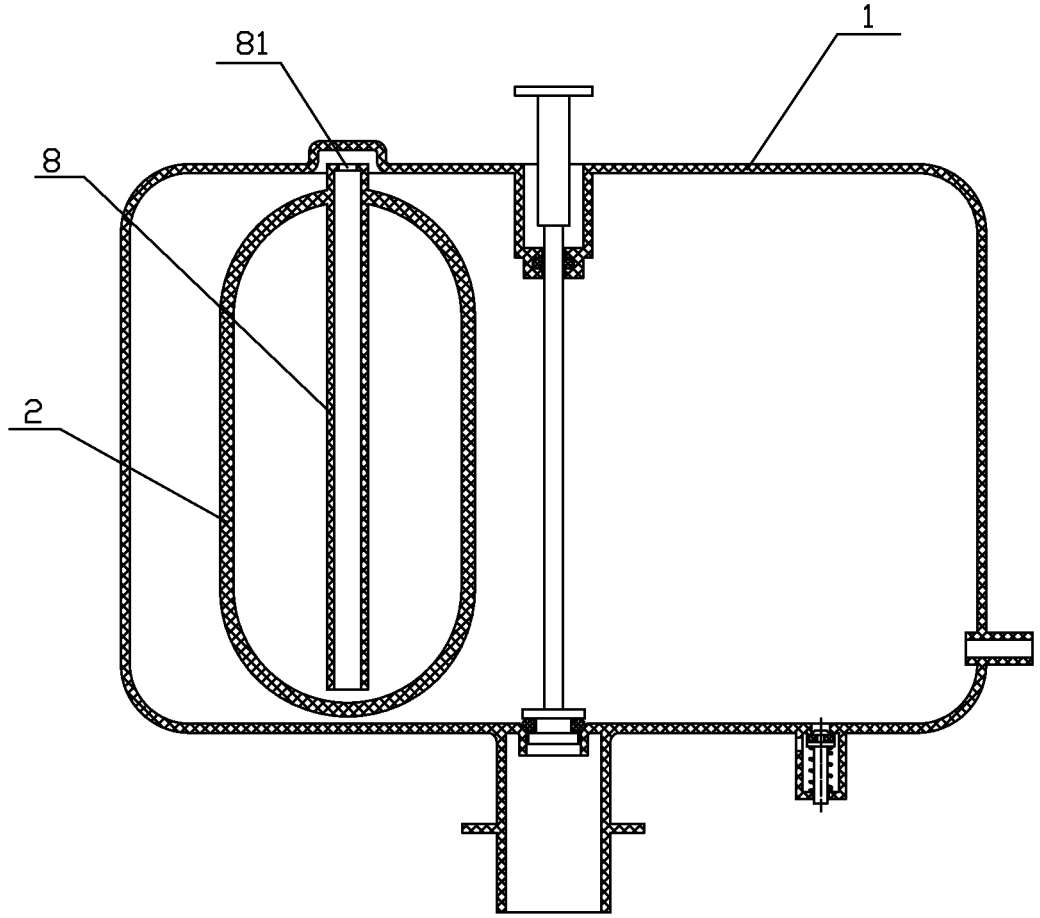
FIG. 7 illustrates a sectional view of the pressure type water tank of the second embodiment of the present invention.

As figured in FIG. 7, different from the first embodiment, an explosion-proof pressure type toilet tank of the second embodiment of the present invention has differences as below: the air container is situated inside the water container 1. Same with the first embodiment, the air container 2 is connected to the water container 1 by a channel, which is a pipe 8 here, different from the first embodiment, one end of the pipe 8 is extended into the bottom of the inner of the air container from the top of the air container 2, the other end of the pipe 8 is situated at the top of the inside of the water container 1, and the opening of this end of the pipe 8 is formed to be a throttle hole 81. So that the air of the water container 1 can completely enter into the air container 2 in one hand, in the other hand, if some water enters into the air container 2, it can be discharged out through the pipe 8. when the tank is taking in water, the air inside the water container 1 is driven to the air container through the throttle hole 81 and the pipe 8 under the work of the water pressure; when the tank flushes, the air inside the air container 2 can be discharged to the water container 1, making the water of the water container 1 driven by the high pressure of the compression air in the upper portion to flush powerfully, reaching flushing and water saving; when the water supply pressure of the water container 1 is too large, and the safety valve 4 is broken or when the manufacture is bad, the material of the water container becomes fatigue after long use and the compression strength is reduced, the water container 1 will first burst to leak as well, the compression air inside the air container will be steadily released through the pipe 8 and the throttle hole 81, no damage will happen.

The Third Embodiment

Figure 8:
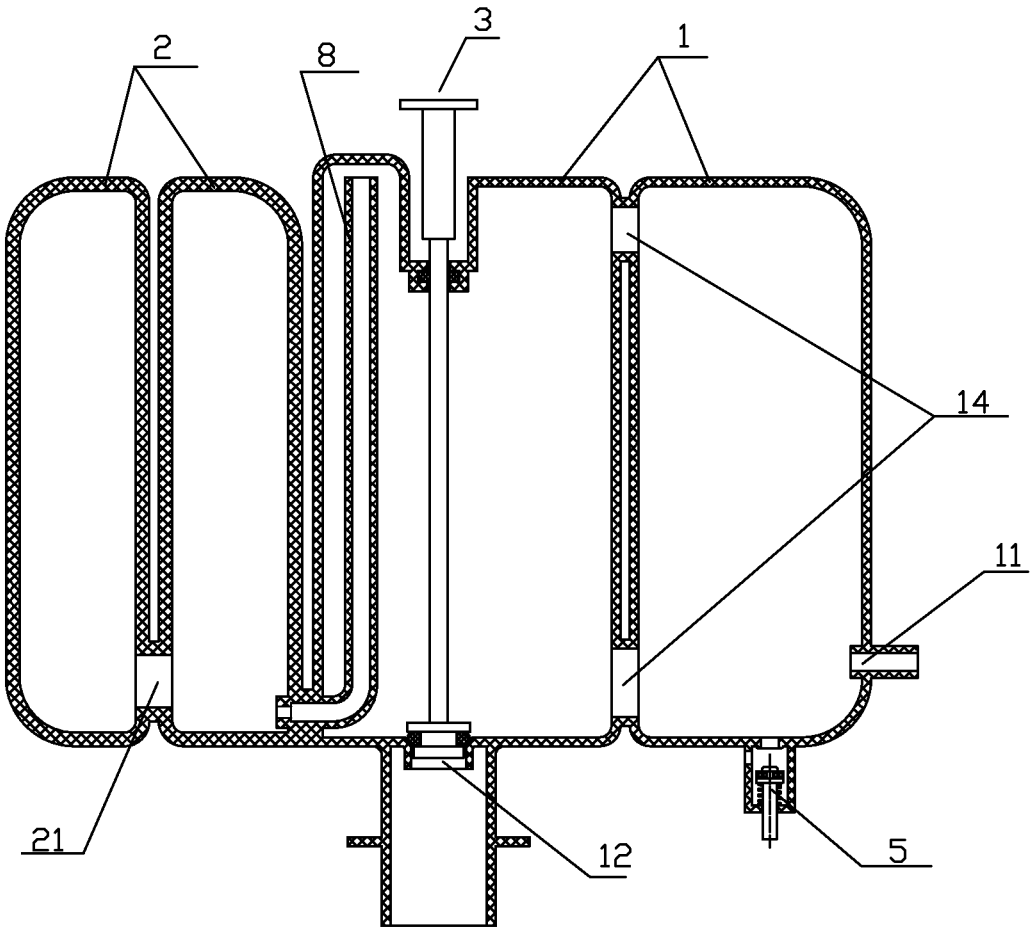
FIG. 8 illustrates a sectional view of the pressure type water tank of the third embodiment of the present invention.

Please refer to FIG. 8. The difference of an explosion-proof pressure type toilet tank of this embodiment of the present invention from the first embodiment is that: there are two air containers and two water containers, two neighboring air containers are connected by a throughout hole 21 at the bottom of the side walls thereof. Two neighboring water containers are connected by a water hole 14 at the bottom of the side wall and at the top of the side wall. Similar to the first embodiment, the air container is connected to the water container by a pipe 8, the water container neighboring to the air container is disposed with an outlet 12 and a flush valve 3, the other water container is disposed with an inlet 11 and a safety valve 5. With the explosion-proof pressure type toilet tank, it can normally take in water and flush, it can prevent explosion as well, ensuring the human being and property security. The third embodiment shows that the number of the air container and the water container is not limited, and it can be applied with two or more air containers and water containers.

In the present invention of an explosion-proof pressure type toilet tank, the air container can be connected to the water container by a hole, for example, the air container is situated on the water container, the two containers are separated by a wall, the wall is disposed with a hole to make the two containers connected. Applied with this method, the water container is full of water when it reaches to working pressure, preventing explosion of the pressure type toilet tank.

In the present invention of an explosion-proof pressure type toilet tank, when the air container is disposed outside the water container and the air container is connected to the water container by a pipe, it can be applied with a connection different from the first embodiment, for example, one end of the pipe is connected to the air container in sealing way, preferred, one end of the pipe is connected to the bottom of the side wall of the air container; the other end of the pipe is connected to the water container in sealing way, for completely discharging the air of the water container to the air container, the other end of the pipe is connected to the top of the water container, or when the top of the water container is in same level, the other end of the pipe is connected to the top of the side wall of the water container. In the same way, with this method, the water container is full of water when it reaches to working pressure, preventing explosion of the pressure type toilet tank.

The Fourth Embodiment

In this embodiment of an explosion-proof pressure type toilet tank, the tank comprises two sections, the upper section of the tank is used to store the air, the lower section of the tank is used to store water, the limit compression strength of the upper section of the tank is larger than that of the lower section, when the pressure of the tank is too great, the lower section of the tank bursts, as the water is not highly compressed, the water flows out of the tank steadily.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. An explosion-proof pressure type toilet tank, wherein the pressure type toilet tank is divided into a closed air container to store air and a closed water container to store water, the air container is connected to the water container by means of a channel, the limit compressive ultimate strength of the air container is larger than that of the water container, wherein the limit compressive ultimate strength of each said container is that value of limit compressive stress reached when a material of each said container fails completely by exceeding its elastic limit;

when the tank is filled with water, the air in the water container enters into the air container through the channel;

when the pressure of the tank is too great, the water container bursts, making the compression air of the air container released steadily through the channel to prevent the compression air therein from quickly blowing out and exploding.

2. An explosion-proof pressure type toilet tank, wherein comprises a closed air container to store air and a closed water container to store water, the water container is comprises an inlet and an outlet;

the limit compressive ultimate strength of the air container is larger than that of the water container, wherein the limit compressive ultimate strength of each said container is that value of limit compressive stress reached when a material of each said container fails completely by exceeding its elastic limit;

the air container is connected to the water container by means of a channel for the air inside the water container to enter into the air container;

when the pressure of the tank is too great, the water container bursts, making the compression air of the air container released steadily through the channel to prevent the compression air therein from quickly blowing out and exploding.

3. An explosion-proof pressure type toilet tank according to claim 2, wherein one end of the channel is connected to the air container, the other end of the channel is situated at the top of the water container.

4. An explosion-proof pressure type toilet tank according to claim 3, wherein the air container is situated outside the water container.

5. An explosion-proof pressure type toilet tank according to claim 3, wherein the air container is situated inside the water container.

6. An explosion-proof pressure type toilet tank according to claim 2, wherein the air container is situated outside the water container.

7. An explosion-proof pressure type toilet tank according to claim 6, wherein the channel is a pipe, one end of the pipe is connected to the air container in sealing way, the other end of the pipe is extended into the water container and is situated at the top of the inner wall of the water container.

8. An explosion-proof pressure type toilet tank according to claim 6, wherein the channel is a pipe, one end of the pipe is connected to the air container in sealing way, the other end of the pipe is connected to the top of the water container in sealing way for the air inside the water container to enter into the air container through the pipe.

9. An explosion-proof pressure type toilet tank according to claim 6, wherein the channel is a hole, the air container is situated on the water container, the bottom wall of the air container is connected to the top wall of the water container by means of the hole.

10. An explosion-proof pressure type toilet tank according to claim 2, wherein the air container is situated inside the water container.

11. An explosion-proof pressure type toilet tank according to claim 10, wherein the channel is a pipe, one end of the pipe is extended into the bottom of the inner of the air container, the other end of the pipe is situated at the top of the inner of the water container.

* * * * *